US005829168A

United States Patent [19]

Fusaro

[11] Patent Number: 5,829,168

[45] Date of Patent: Nov. 3, 1998

[54] STEP SHOCK-ABSORBING, FASHIONABLY RAISED HEEL FOR LADIES' AND GENTLEMEN'S FOOTWEAR

[76] Inventor: Ingeborg Fusaro, Werinherstrasse 16, 81541 München, Germany

[21] Appl. No.: 853,094

[22] Filed: May 8, 1997

Related U.S. Application Data

[62] Division of Ser. No. 283,738, filed as PCT/DE93/00075 Feb. 19, 1993, abandoned.

[30] Foreign Application Priority Data

| | | | |
|---|---|---|---|
| Jan. 30, 1992 | [DE] | Germany | 9201107 U |
| Jun. 11, 1992 | [DE] | Germany | P 42 19 152.1 |
| Jul. 3, 1992 | [WO] | WIPO | PCT/DE92/00563 |
| Jul. 10, 1992 | [DE] | Germany | 9209230 U |
| Oct. 4, 1992 | [DE] | Germany | 9213302 U |
| Oct. 7, 1992 | [WO] | WIPO | PCT/DE92/00845 |

[51] Int. Cl.[6] ..... A43B 21/26; A43B 21/06

[52] U.S. Cl. ..... 36/34 B; 36/35 R; 36/35 B

[58] Field of Search ..... 36/34 R, 35 R, 36/35 B, 35 A, 34 B

[56] References Cited

FOREIGN PATENT DOCUMENTS

| | | |
|---|---|---|
| 1128327 | 4/1962 | Germany . |
| 2312938 | 9/1974 | Germany . |
| 2431420 | 1/1975 | Germany . |
| 2336314 | 2/1975 | Germany . |
| 78 15 835 | 10/1978 | Germany . |
| 79 32 259 | 2/1980 | Germany . |
| 2908023 | 9/1980 | Germany . |
| 83 16 581 | 11/1993 | Germany . |
| 1366270 | 9/1974 | United Kingdom . |
| 2032761 | 5/1980 | United Kingdom . |

OTHER PUBLICATIONS

International Search Report dated Apr. 21, 1993 issued in PCT/DE93/00075 (parent).

Translation of International Preliminary Examination Report dated Oct. 28, 1993 issued in PCT/DE93/00075 (parent).

Search report dated May 25, 1992, issued in German Utility Model Application G92 01 107.1, which is related to the above identified application.

*Primary Examiner*—Ted Kavanaugh

*Attorney, Agent, or Firm*—Whyte Hirschboeck Dudek SC

[57] ABSTRACT

A step shock-absorbing raised shoe heel assembly, fashionably raised for ladies' and gentlemen's footwear, of a high-heeled shape or having a wedge shape, which consists of an inelastic, nonpliable rigid inner core body (1) and a springy elastic, rubber-flexible soft outer envelope (6), manufactured in one piece structure. The outer envelope (6) surrounds the core body (1) at least on three sides, namely around the circumferential side (102*d*) and the bottom (102*b*) or walking side (33). The core body (1) can also be enveloped on all sides, namely as well as on its upper side (102). The rigid inner core body (1) of the shoe heel assembly represents the stabilizing unit and the elastic outer envelope (6) represents the step shock absorbing unit.

43 Claims, 3 Drawing Sheets

Fig. 14
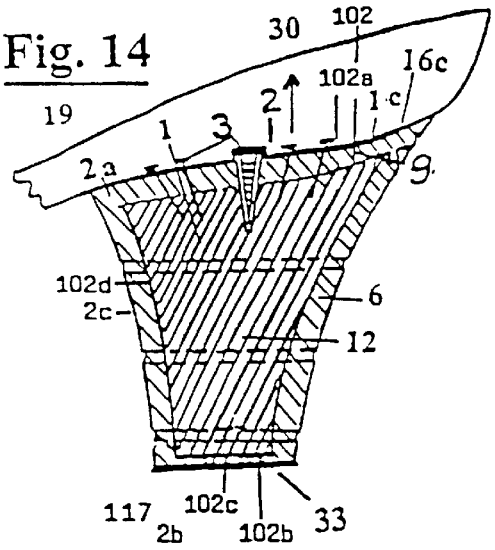
Fig. 15
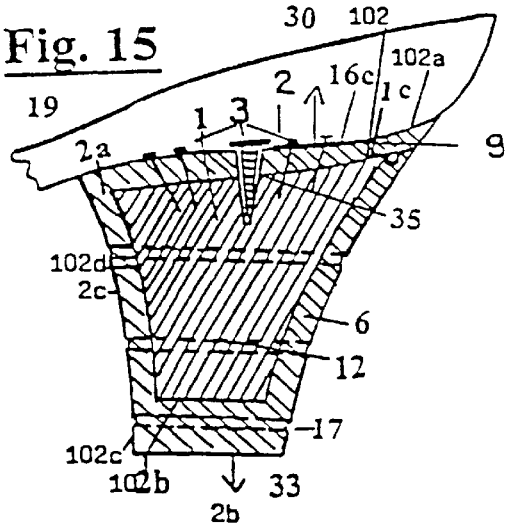
Fig. 16
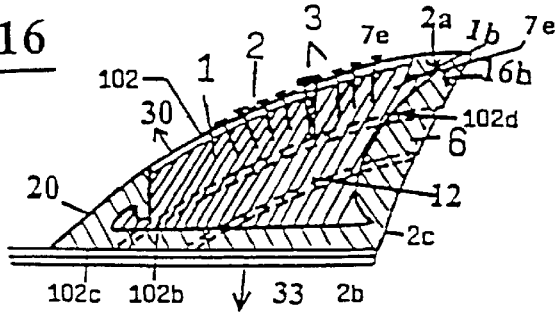
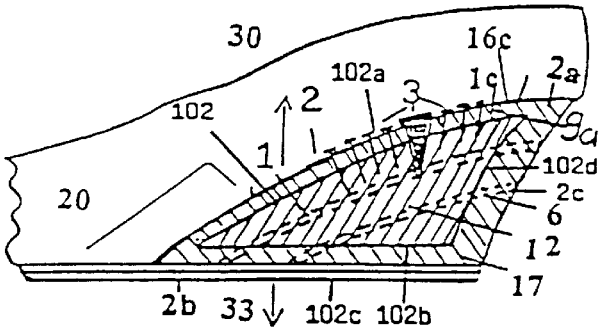
Fig. 17
Fig. 18
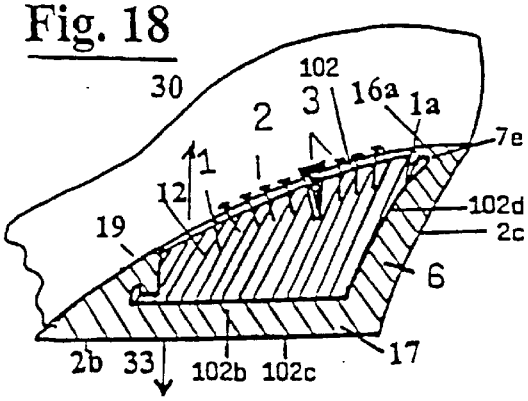

STEP SHOCK-ABSORBING, FASHIONABLY RAISED HEEL FOR LADIES' AND GENTLEMEN'S FOOTWEAR

CROSS-REFERENCE TO RELATED APPLICATIONS

This is a divisional of application Ser. No. 08/283,738 filed on Aug. 1, 1994 now abandoned, which is a continuation of International Application PCT/DE93/00075 filed on Feb. 1, 1993 which designated the U.S.

This application is a continuation-in-part application of an international application filed under the Patent Cooperation Treaty on Feb. 1, 1993, bearing Application No. PCT/DE93/00075, and listing the United States as a designated and/or elected country. The entire disclosure of this latter application, including the drawings thereof, is hereby incorporated in this application as if fully set forth herein.

FIELD OF THE INVENTION

The present invention relates to a step shock-absorbing fashionably raised shoe heel for ladies' and gentlemen's footwear of a high-heeled shape or having a wedge shape, wherein the heel is of a closed structure on the upper side as well as on the lower side, wherein the heel includes a rigid, nonpliable, inelastic solid or hollow core body, which core body represents a stabilizing unit made of wood or rigid synthetic material, and wherein the core body is arranged in a flexible outer envelope representing the shock-absorbing unit made of a soft elastic material.

BRIEF DESCRIPTION OF THE BACKGROUND OF THE INVENTION INCLUDING PRIOR ART

The German Published Patent Application DE-OS 29 33 393 refers to a shaped shoe sole with a flat, wide shoe heel of low height, where the heel is step shock absorbing and has a soft-elastically constructed core with a high inherent shock absorbing coefficient. The heel further exhibits an outer envelope made of an elastic material, manufactured in a one-piece structure. Said outer envelope is closed at the bottom and sidewards, and is made of a flexible synthetic or rubber material and represents the shock absorbing unit.

The outer heel wall represents the springy unit, while the core, made of a foam or an elastic synthetic material with a high inherent shock-absorbing coefficient, is disposed in the inner hollow space as a shock absorbing unit.

This German Published Patent Application DE-OS 29 33 393 discloses a heel, where the outer envelope represents the springy unit and the core represents the shock absorbing unit, i.e. both elements, the outer envelope and the core, do not have a stabilizing feature. The shock-absorbing core as well as the springy outer envelope are pliable to the same extent. The height of the upright outer envelope is identical to the height of the upright core when subjected to load, since both elements are compressed equally to the same extent. Thereby it is possible that the outer envelope is compressed up to the core when the heel is subjected to load.

For flat, sporty footwear, this reference construction is an optimal solution for dual step shock absorbency since the result is that the body can save energy and the ankle joints and knee joints are extremely relieved. For a shoe heel of a greater height elevation, where the heel is tapered toward the heel bottom end and the heel tread surface is thus reduced, no stability is obtained to prevent a lateral yielding of a heel with a soft elastic core. The step shock absorbing feature of the component's soft core and soft envelope would allow the slim heel to break in a lateral direction. The height of the soft elastic core is equal to the height of the soft elastic outer envelope. A step execution function is not given either.

The German Published Patent Application DE OS 29 08 023 describes a fashionably raised heel comprising different wedge parts. The intermediate wedge-shaped layers are made of an elastic material, are attached at an upper support face and at a bottom support face, and exhibit preferably about the same thickness over the total heel cross section. It is an object of the invention of the German Published Patent Application DE OS 29 08 023 to provide a shoe heel, where a sufficient spring characteristic is provided, while at the same time a horizontal shift of the lower part of the heel is reduced to a minimum.

According to the German Published Patent Application DE-OS 29 08 023 both support areas are provided with oppositely disposed first and second segments. The first segment is directed obliquely from the upper side to the lower bottom side as seen in walking direction and the second segment is directed from the lower bottom side to the upper side as seen in walking direction, i.e. the segments are directed in the opposite direction relative to each other. Since the heel is composed of several parts and since these parts are constantly exposed to a high degree of mobility and friction based on the constant and continuous compression and decompression, this type of heel will have to face problems of durability and wearability properties and it will be difficult to realize such a heel construction in most every fashionably raised heel shapes, in particular since a factor of high costs has to be taken into consideration.

SUMMARY OF THE INVENTION

It is an object of the present invention to improve and further develop conventional shapes of heels in such a manner as to guarantee sufficient stability against lateral yielding and bending of the heel and to ensure a safe step execution function in the case of slim heels of a greater height elevation and having a comparatively small step face and tread surface while at the same time delivering a high shock absorbing effect.

It is a further object of the present invention to provide structures and materials which, based on their composition and arrangement relative to each other, permit the desired further development and enable improved technical features of the invention heel.

It is a further object of the present invention to provide a heel of a shoe which can be manufactured under economic production conditions.

These and other objects and advantages of the present invention will become evident from the description which follows.

The present invention is a step shock-absorbing, raised shoe heel, of a high-heeled shape or having a wedge shape, having an upper surface and a lower bottom surface, comprising an inelastic, nonpliable and rigid inner core body, which shape corresponds accurately to the high-heeled or conical wedge shape of the heel and a one-piece structure springy elastic outer envelope, made of flexible synthetic or rubber material, which encloses at least the bottom and circumferential sides of the core body, wherein the outer envelope in unloaded condition has a greater height elevation than the rigid inner core body. The rigid inner core body represents the stabilizing unit and the soft outer envelope represents the shock absorbing unit of the present invention.

The soft outer envelope has, when subjected to load, an elastic compressible shock absorbing part compressible vertically in the direction of the longitudinal axis of the shoe heel, absorbing the weight during step in a springy elastic manner. In an preferred embodiment, the outer envelope may comprise an envelope lid enclosing the core body on all sides within the outer envelope.

DETAILED DESCRIPTION OF THE INVENTION

The present invention provides a heel exhibiting an upper surface and a bottom surface. The heel includes a rigid inner core body representing the stabilizing unit. The material of the rigid inner core body is nonpliable and rigidly inelastic and has no inherent shock absorbing coefficient and is a material with a high density, for example high-density polyethylene, polyamide, polypropylene or another rigid material. The material of the rigid inner core body has an elasticity from the upper end of the Shore D hardness to a higher degree Shore hardness range, and has a specific gravity between 0.9 to 2.0 g/cm$^3$. The rigid core body can also be made of a wood. The core body can be formed as a solid core body or the core body can be formed as a hollow core body. The outer edge of the upper surface of the core body can have various structures and the inner edge of the upper surface of the outer envelope can have various structures, where the respective structure of the core body corresponds and matches the respective structure of the outer envelope. Such a structure can be a rounded off gradation, an acute or straight hook structure, or a totally straight upper surface or said outer edge has a flattened structure. The structure of the outer edge of the upper surface of the core body is such as to engage the structure of the inner edge of the outer envelope. The circumferential face of the core body towards the lower bottom surface can have a parallel conical taper, an inherent concave taper, a conical taper with convex bulge, and the core body can be vertically vertical shifted in its height towards the upper surface and/or bottom face. The outer surface of the core body is surrounded on all sides or at least on three sides with the outer envelope, i.e. at least the circumferential area of the core body and the bottom side or walking side of the core body or the core body is surrounded on all sides by the outer envelope. The outer envelope represents the shock absorbing unit and is made of a thick layer of soft elastic material which can be varied with regard to its Shore hardness degree and consists for example of polyurethane, Thermical rubber, thermoplastic caoutchouc, rubber material or other suitable soft flexible synthetic materials. In the unloaded condition of the shoe heel, the outer envelope exhibits a greater height elevation than the core body. The wall thickness of the outer envelope is dependent on the outer circumferential wall surface and can exhibits its greatest wall thickness on the bottom side of the shoe heel, the upper side of the shoe heel or at the side walls of the shoe heel. The inner core body exhibits essentially the same shape as the outer envelope, less the thickness of the outer envelope. The outer envelope can be is loosely placed over the core body or can be loosely connected at all inner surfaces of the outer envelope to the core body, or the core body is firmly connected to all inner surfaces of the outer envelope. Alternatively, only the upper surface of the core body is connected firmly to the inner wall of an envelope lid, i.e. the circumferential outer surface and the bottom surface of the core body are not connected to the inner circumferential wall surface and the inner bottom surface of the outer envelope. The outer envelope can include a sealable or closed lid to form a closure of the upper surface of the shoe heel. The outer surface of the shoe heel or the outer envelope can include horizontal grooves. The shape of the heel is variable with regard to height, width, depth and gradations. An independent heel patch consists of the same material as the outer envelope and can be provided having a standard height level or having an elevated height level when the heel is manufactured in that the envelope is injection molded around the heel core with a minimum layer at the core's lower bottom face. The heel patch can also be injection molded in a one-piece structure in the same injection molding operation together with the bottom outer wall of the outer envelope. The bottom surface of the core body can include predrilled holes for inserting rigid pins of a heel patch and the upper surface of the core body can include predrilled holes for attaching the finished shoe heel to the shoe shaft. The shoe heel can be produced as a completely independent part or the shoe heel can be produced with a shoe sole in one unit. The upper side of the shoe heel is attached to the shoe upper by screws, nails, or bonding or the shoe heel is attached to the shoe shaft with a blind rivet and nails. The shoe heel is a self-contained unit, where the upper surface of the shoe heel is closed with the upper surface of the core body and the higher side walls of the outer envelope. Alternatively the upper surface of the shoe heel can be closed with an envelope lid and the side walls of the outer envelope. The shoe heel can be of the high-heeled shape and exhibits a comparatively small, slim bottom face. The shoe heel can have a high-heeled shape or conical wedge shape. The shoe heel is clamped into position with its outer higher envelope wall or lid during assembly to the shoe upper.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible exemplified embodiments of the present invention:

FIG. 14 is a view of a vertical longitudinal section of a high-heeled shape with an inner core body extending almost towards the end of the heel in direction of the step face;

FIG. 15 is a view of a vertical longitudinal section of a high-heeled shape having a core body with a straight upper surface and having a sealable outer envelope lid and a removable outer envelope;

FIG. 16 is a view of a vertical longitudinal section of a wedge-shaped heel with sole injection molded as a unit sole, having a gradated core body and a removable flanged outer envelope;

FIG. 17 is a view of a vertical longitudinal section of a wedge-shaped heel, manufactured as a unit sole, where a sole is injection molded having an attached heel, and including an envelope lid, and a core body having a straight upper surface;

FIG. 18 is a view of a vertical longitudinal section of a wedge-shaped heel, wherein the heel is injection molded independently, and having a graduated core body, and a removable flanged outer envelope.

Figure 1:
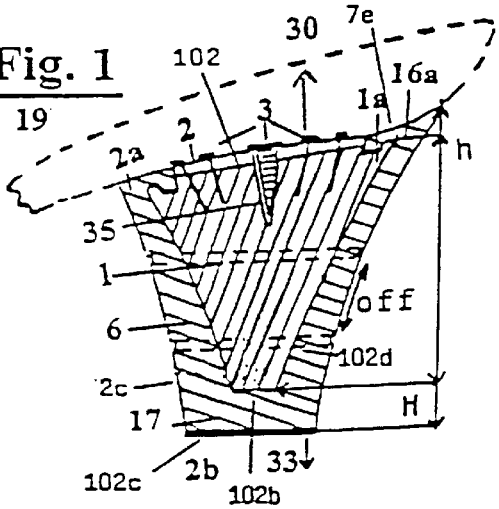
FIG. 1 is a view of an upright longitudinal section of a high heeled shape with a tapered inner core body, and a removable rounded off flanged outer envelope.

| Reference Numbers of Signs and Symbols | |
|---|---|
| h | vertical height core; |
| H | vertical height envelope; |
| a1 | standard height elevation of a heel patch; |
| a2 | elevated height of a heel patch; |
| 1 | rigid inner core body; |
| 1a | rounded off rim gradation; |
| 1b | acute-angled rim-hook or straight-angled rim hook gradation; |
| 1c | horizontal upper totally straight plane surface of the core; |
| 1d | flattened rim gradation of the core body; |
| 1e | hump gradation of the core body; |
| 2 | upper surface of shoe heel; |
| 2a | slightly raised side wall or lip of the envelope; |
| 2b | lower bottom surface of shoe heel; |
| 2c | circumferential side envelope and shoe heel assembly; |
| 3 | attaching screw for attachment to the shoe upper; |
| 3 | attaching nails for attachment to the shoe upper; |
| 6 | soft elastic outer envelope; |
| 7e | upper outer edge of the core body; |
| 8 | fixed connection between inner surface soft outer envelope and outer surfaces inner rigid core body; |
| 9 | closable envelope cover; |
| 9a | closed envelope cover; |
| 10 | metal or rigid synthetic ring around attaching screw; |
| 11 | grooves in the outer view surface with various courses; |
| 12 | solid core body; |

-continued

| Reference Numbers of Signs and Symbols | |
|---|---|
| 12a | hollow core body; |
| 13 | blind-rivet inserted into the interior space of the rigid inner core body; |
| 14 | smooth vertical outer view surface of the shoe heel; |
| 16a | rounded off flanged border of the soft outer envelope; |
| 16b | acute-angled flanged hook and/or straight flanged border of the outer soft envelope; |
| 16c | totally straight plane upper side surface of the envelope lid; |
| 16d | flattened flanged border of the soft outer envelope; |
| 16e | decorative rim adjacently surrounding the upper of the soft outer envelope wall; |
| 17 | heel patch in one process injection molded with envelope; |
| 17a | heel patch separately injection molded same material; |
| 18 | heel patch standard height, a1; |
| 18a | heel patch elevated height, a2; |
| 19 | shoe heel completely independent part, without connected shoe sole, sole made of another material; |
| 20 | shoe heel assembly dependent manufactured connected unit, namely shoe heel assembly and shoe sole in a connected shoe sole unit made of a material of the outer soft outer envelope manufactured in a dependent unit; |
| 30 | facing the shoe upper; |
| 33 | facing the tread side; |
| 35 | predrilled holes vertical provided in the upper side of the core body; |
| 100 | rigid pins of the heel patch for inserting in the predrilled holes of the core; |
| 102 | horizontal upper surface core; |
| 102a | horizontal upper surface envelope; |
| 102b | horizontal bottom surface core; |
| 102c | horizontal bottom surface envelope; |
| 102d | circumferential side surface core; |
| 110 | predrilled holes vertical provided, facing the shoe upper; and |
| 117 | minimum layer around the bottom side surface of the core body. |

One aspect of the present invention is that of a step shock-absorbing raised shoe heel, fashionably raised for ladies' and gentlemen's footwear, of the high-heeled shape or having a wedge shape, which consists of an inelastic, nonpliable rigid inner core body and a springy elastic, rubber-flexible soft outer envelope, manufactured in one piece structure. The outer envelope surrounds the core body at least on three sides, namely around the circumferential side and the bottom or walking side. The core body can also be enveloped on all sides, namely as well as on its upper side. The rigid inner core body of the shoe heel represents the stabilizing unit and the soft elastic outer envelope represents the shock absorbing unit.

In an preferred embodiment the present invention is a shock absorbing raised shoe heel, with an inner core body and a springy, elastic outer envelope, closed at the bottom, therefore on the walking side, made of flexible synthetic- or rubber-material, manufactured in one piece structure, representing the shock absorbing unit, wherein in the shoe heel has an upper surface (2) and a lower bottom surface (2*b*), wherein the inner core body (1), representing the stabilizing unit, is inelastic, nonpliable and rigid, and wherein the one-piece springy, elastic rubber-flexible outer envelope (6) in unloaded condition has a higher height elevation than the rigid inner core body (1).

According to the present invention there is provided a step shock absorbing shoe heel of a greater height elevation having a high heeled or conical wedge shape 2. The shoe heel exhibits a horizontal bottom surface 2*b,* i.e. on the walking or tread side 33, and a horizontal upper surface 2, i.e. on the surface facing a shoe upper 30. The heel essentially includes a rigid inner core body 1, representing the stabilizing unit and is made of an inelastic, rigid material, and a springy elastic outer envelope 6, manufactured as a one piece structure and representing the shock absorbing unit. The outer envelope 6 is made of a flexible synthetic or rubber material.

In accordance with the invention, the stability against lateral yielding and buckling is achieved by using an inelastic rigid inner core body. The shock absorbency is achieved by the outer envelope, manufactured in one piece and consisting of soft elastic, flexible rubber or synthetic material.

The substance of the invention shoe heel is based on the arrangement of a suitable material component of the stabilizing unit and of the shock absorbing unit. In this case, the composition of the materials and the arrangement relative to one another are of importance to ensure the stability of the step execution function also in slim heels of a greater height elevation with comparatively small step face and nevertheless a high shock-absorbing effect is obtained to an optimal degree.

The step shock absorbing raised heel according to the invention having a high-heeled or conical wedge shape consists of two different elements made of two different materials. Such high-heeled or conical wedge-shaped heels are illustrated in FIGS. 1–3, 5–8, and 10–18.

Figure 3:
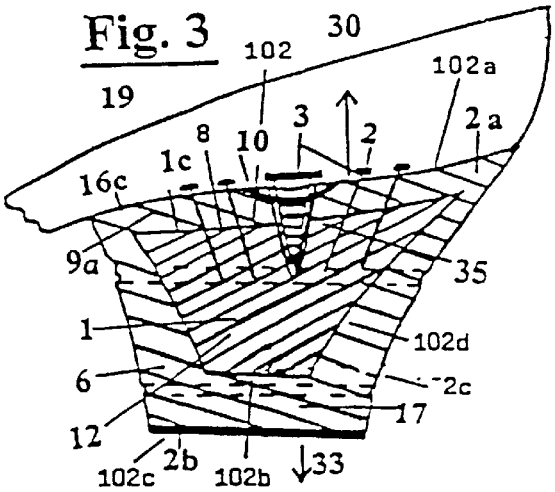
FIG. 3 is a view of a vertical longitudinal section of a high heeled shape with a straight upper surface of the inner core body and a firmly attached envelope lid, where the core body is enveloped on all faces with a layer of elastic material.
Figure 2:
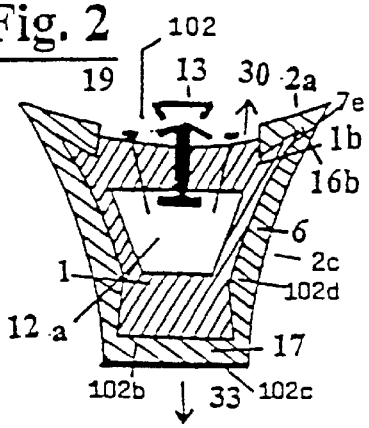
FIG. 2 is a view of a vertical cross-section of a heel having a hollow inner core body and with a acute hooked graduated inner core body and a removable flanged outer envelope.
Figure 4:
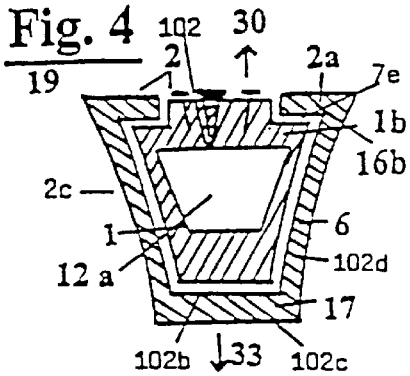
FIG. 4 is a view of a vertical cross section of a heel with a hollow core body, with a straight graduated core body, and with a removable flanged outer envelope.

A rigid, inelastic, nonpliably formed inner core body 1, representing the stabilizing unit, can be provided as a light-weight solid 12 inner core body 1, as illustrated in FIGS. 1, 3, 5–8, 10, 14–18 and/or as a hollow 12*a* inner core body 1, as illustrated in FIGS. 2 and 4. The inner core body 1 is made of wood or of a rigid synthetic material. The material of the rigid inner core body 1 is nonpliable and rigidly inelastic and has a none inherent shock absorbing coefficient and is a material having a high density, for example high-density polyethylene, polyamide, polypropylene or other rigid material. The material of the rigid inner core body 1 has an elasticity from the upper end of the Shore D hardness range to an upwards higher shore hardness range, having a specific gravity between 0.9 to 2.0 g/cm$_3$.

The rigid inner core body 1 has a vertical height h, an upper surface 102 facing the shoe upper 30, an outer circumferential side 102*d*, and a horizontal bottom side 102*b* facing a tread area 33. The upper surface 102 of the rigid inner core body 1 exhibits an upper outer edge 7*e*, where the upper outer edge 7*e* can be of varying shapes.

Figure 9:
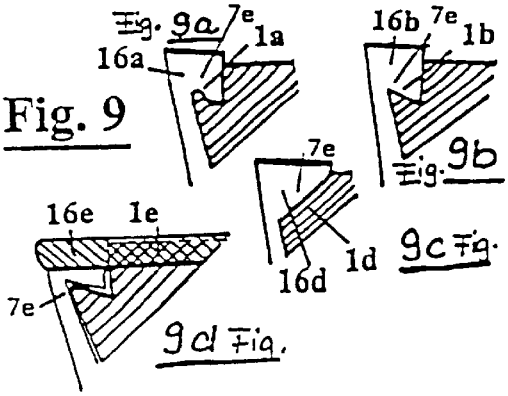
FIG. 9 is a view of an enlarged vertical longitudinal section of gradations of a rigid core body and corresponding flanging of an outer envelope.

The upper surface 102 of the rigid inner core body 1 can exhibit for example an approximately straight upper surface 1*c*, as illustrated for example in FIGS. 3, 5, 7, 10, 14, 15 and 17, or the outer edge 7*e* of the upper surface 102 of the rigid inner core body 1 exhibits for example a rounded-off rim gradation 1*a*, as illustrated in FIG. 9*a*, or an acute-angled or straight-angled rim hook 1*b*, as illustrated in FIG. 9*b*, or a flattened rim 1*d*, as illustrated in FIG. 9*c* and FIG. 4, or a hump 1*e*, as illustrated in FIG. 9*d*.

The outer circumferential side 102*d* of the rigid inner core body 1 can exhibit an equal-angled and/or unequal-angled, equal-sided or unequal-sided rectangular shape, a trapezoid shape, a triangular shape, a square shape, a cone shape or an upside-down truncated cone shape.

The outer circumferential vertical side walls 2*c* of the shoe heel can for example have a rounded-off shape. The vertical sides are rounded-off in the vertical external extension approximately in the circumference of the external backside measured from the external edges of the external upper surface 2 to the side of the external bottom surface 2*b*.

The inner vertical side wall of the shoe heel, facing in the direction of the toe-cap of a shoe, can for example be straight, as viewed from the upper surface 2 of the shoe heel to the bottom surface 2*b* of the shoe heel.

The outer shape of the shoe heel can also have an outer vertically sloped angle as viewed from the upper surface 2 of the shoe heel to the bottom surface 2*b* of the shoe heel.

The upper surface 2 of the shoe heel can exhibit a horizontal slope as viewed from the back of the heel to the front of the heel, i.e. extending along a center longitudinal axis of the shoe heel.

The external upper horizontal width of the upper surface 2 of the shoe heel can be, for example, from 3 to 8 cm.

The external upper horizontal longitudinal length of the upper surface 2 of the shoe heel can be, for example, from 4 to 15 cm.

The lower external horizontal bottom width of the external horizontal bottom surface 2*b* of the shoe heel can be, for example, from 1 to 8 cm.

The lower horizontal longitudinal length of the external lower horizontal bottom surface 2*b* of the shoe heel can be, for example, from 1.5 to 14 cm.

A springy, elastic outer envelope 6 is formed of a layer of a rubber-flexible and elastic material and represents the shock absorbing unit. The Shore hardness of the layer of rubber-flexible and elastic material can be varied. The outer envelope 6 surrounds the rigid inner core body 1 on at least three sides, namely on the outer circumferential vertical side 102*d* and on the horizontal bottom side 102*b*, or tread side 33 of the rigid inner core body 1, as illustrated in FIGS. 1, 2, 4, 5, 6, 8, 13, 16 and 18, or on all sides as well as on the upper side (102), as illustrated for example in FIGS. 3, 7, 10, 14, 15 and 17.

The shoe heel is closed at its upper surface 2 and at its bottom surface 2*b* and is manufactured in various heights and widths, depth and gradation.

The shoe heel is a self-contained unit including the upper surface 102*a* of outer envelope 6 and/or the upper surface 102 of the rigid inner core body 1, as illustrated for example in FIGS. 3 and 1.

Figure 6:
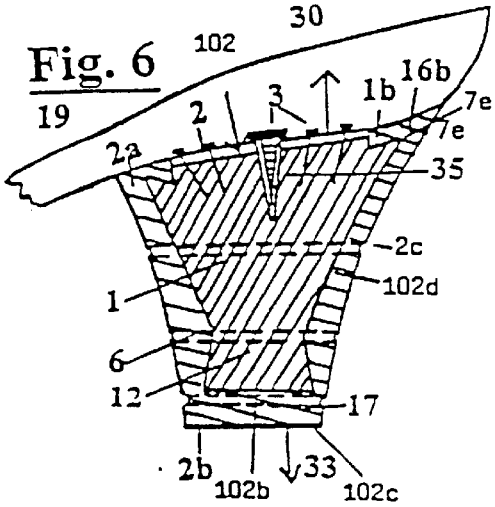
FIG. 6 is a view of a vertical longitudinal section of a high-heeled shape including a hooked graduated core body, a flanged envelope, having a convex formation towards the bottom side of the core body.

The shoe heel is self-contained towards the shoe upper 30 with the externally higher side walls 2*a* of the outer envelope 6 and the upper surface 102 of the rigid inner core body 1, as illustrated in FIGS. 1 and 6.

Figure 7:
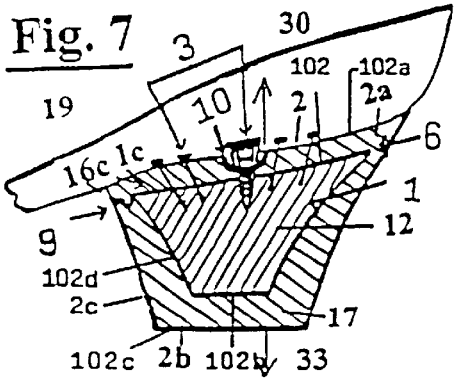
FIG. 7 is a view of a vertical longitudinal section of a heel with a core body having a straight upper surface, and wherein the injection molded outer envelope having a sealable lid, and is removable.

The shoe heel is self-contained towards the shoe upper 30 with an envelope lid 9, 9*a* and with the upper side walls 2*a* of the outer envelope 6, as for example illustrated in FIGS. 3 and 7.

Figure 5:
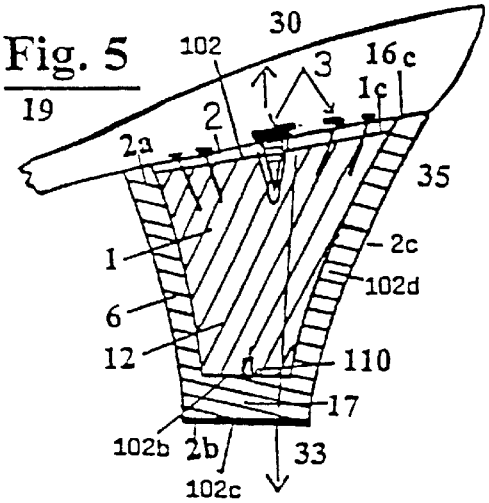
FIG. 5 is a view of a vertical longitudinal section of a high-heeled shape with a straight upper surface of the solid core body and without a lid, wherein the core body is firmly connected to the lateral inner side walls of the outer envelope.
Figure 8:
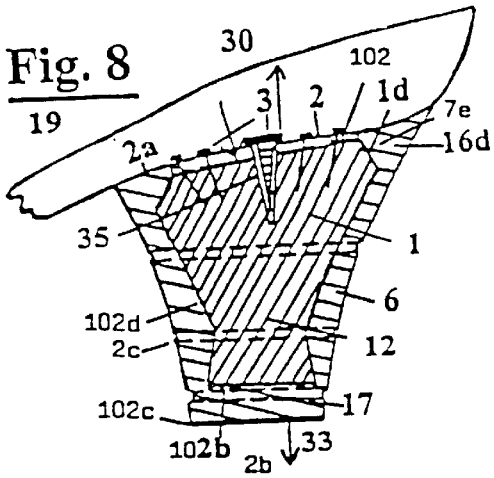
FIG. 8 is a view of a longitudinal section of a heel having a solid core body and an outer envelope, where a flanged border of the outer envelope and a corresponding flattened core body rim are formed as a snap lock, wherein the envelope is removable without removing the heel.

The shoe heel is self-contained towards the shoe upper 30 with the upper surface 102 of the rigid inner core body 1 and the vertical external slightly raised side walls 2*a* of the outer envelope 6, as illustrated in FIGS. 5 and 8.

The outer envelope 6 is constructed as a one-piece structure and made of a soft-elastic, pliable material. The soft-elastic, soft-flexible synthetic material or rubber material is preferably an elastomer, for example, a Thermical rubber, thermoplastic rubber (caoutchouc), soft polyvinyl chloride (PVC), polyurethane, thermoplastic polyurethane or any other soft material with a high inherent shock absorbing coefficient measured in the elasticity module of Shore A hardness range, preferably between 60 to 80 degrees, but variable upward or downward of the level of the Shore A hardness with a specific gravity of between 0.5 to 1.2 g/cm$^3$. The Shore hardness can be varied, depending on the intended use of the heel and on the shape of the heel. The heel exhibits a part, which can be vertically elastically compressed in the direction of its longitudinal axis at the time when the shoe heel makes a first contact with the floor. This vertically elastically compressed part, forming the soft outer envelope 6 thus absorbs the weight of a person performing a step in a springy elastic manner.

In unloaded condition of the shoe heel, the vertical height H of the outer envelope 6 is higher elevated than the vertical height h of the rigid inner core body 1. The thereby resulting shock absorbing effect is based on the fact that, at the point in time when the heel makes a first contact with the floor, both the edge region of the heel patch 17, 17*a* as well as the region of the outer envelope, neighboring to and supporting the heel patch 17, 17*a,* contributes by deformation to the elastic shock absorbency.

The soft outer envelope 6 can exhibit various shapes and wall thicknesses, where the outer surface of the envelope 6 defines the finished outer shape of the heel and where the inner surface of the envelope 6 essentially corresponds to the contours of the rigid inner core body 1.

Figure 10:
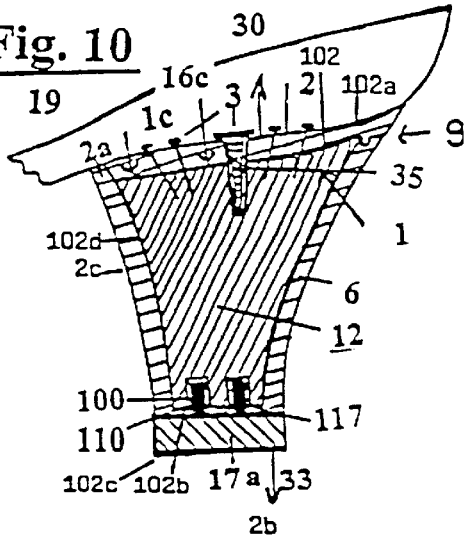
FIG. 10 is a view of a vertical longitudinal section of a high-heeled shape, having an independent heel patch present at a standard height level.

The wall thickness of the soft outer envelope 6 can have its largest thickness at the horizontal upper surface 102*a,* as for example illustrated in FIGS. 10 and 14. Alternatively, the soft outer envelope 6 can have its largest thickness at the circumferential side walls 2*c,* as illustrated in FIGS. 1, 6, 8, 16, 17, to compensate for example for a convex bulging of the outer contour of the rigid inner core body 1. The soft outer envelope 6 can also have its largest thickness at the horizontal bottom side 102*c,* as illustrated in FIGS. 15, 16, 17 and 18.

The soft outer envelope 6 has a horizontal bottom side 102*c,* a horizontal upper side 102*a,* and circumferential side walls 2*c*. The wall thickness of the soft outer envelope 6 can be, for example, from 2 mm to 8 mm. The location of the greatest wall thickness of the outer envelope 6 depends on the configuration of the rigid inner core body 1. Thus, depending on the shape of the rigid inner core body 1, the largest wall thickness of the outer envelope 6 can be located on the horizontal bottom side 102*c* and/or the horizontal upper side 102*a,* and/or in the circumferential side walls 2*c* of the outer envelope 6.

Figure 11:
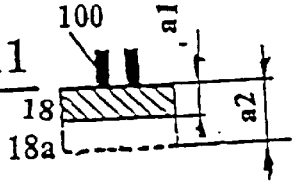
FIG. 11 is a view of a vertical longitudinal section of a heel patch illustrated at a standard and at a elevated height level.

The shape of the heel is variable with regard to height, width, depth, gradation and formations. A heel patch 17 can be injection-molded in one piece structure together with the lower circumferential side walls 2*c* of the outer envelope 6, as illustrated for example in FIGS. 2–4, 5–8 and 15–18. Alternatively, the heel patch 17*a* can be separately manufactured ready for assembly or as a repair spare heel patch. As illustrated in FIG. 11, the separately manufactured heel patch 17*a* can have a standard thickness a1 or an elevated thickness a2 to compensate for a difference in length of one leg relative to the other leg. The separately manufactured heel patch 17*a* consists of the same material as the outer envelope and includes one or a plurality of pins 100 made of a rigid synthetic material. When an invention shoe heel is being repaired, the pins 100 are inserted into one or a plurality of predrilled holes 110 in the horizontal bottom side 102*b* of the rigid inner core body 1. The outer surface of the rigid inner core body 1 and the inner surface of the soft outer envelope are of a form-matching shape. The outer shape of the rigid inner core body 1 corresponds in principle approximately to the outer shape of the outer envelope 6, minus the wall thickness of the outer envelope 6. The outer shape of the outer envelope 6 defines the prepared injection mold for the injection molding operation.

The inner edge of the upper surface 102*a* of the outer envelope 6 can exhibit for example an approximately straight lip 2*a,* as illustrated in FIG. 5, or a rounded-off lip of a flanged border 16*a,* as illustrated in FIG. 9*a,* or an acute-angled or straight-angled lip hook of the flanged border 16*b,* as illustrated in FIG. 9*b* and FIG. 4, or a flattened lip of a flanged border 16*d,* as illustrated in FIG. 9*c,* or a decorative flange 16*e,* as illustrated in FIG. 9*d,* or the horizontal upper side surface 102*a* is totally straight (16*c*), e.g. as illustrated in FIG. 3.

The attachment and demounting of the heel formed by the rigid inner core body 1 and the outer envelope 6 can be easily performed where the outer edge 7*e* of the upper surface 102 of the inner core body 1 is provided with a specific structure and the inner edge of the upper horizontal side 102*a* of the outer envelope 6 is provided with a correspondingly specific structure, and where these two structures engage form-matchingly into each other. In a preferred embodiment, the present invention is a step shock absorbing raised shoe heel assembly, of a high-heeled shape or having a wedge shape, comprising an inner core body representing the stabilizing unit, being a geometrical body, wherein the shape of the rigid inner core body (1) corresponds accurately to the high-heeled or conical wedge shape of the heel and wherein the rigid inner core body (1) has a vertical height (h) an outer upper surface (102) facing a shoe upper (30), vertical circumferential sides and a bottom side facing a tread area (33), wherein the upper surface (102) of the inner core body (1) exhibits an upper outer edge (7*e*); wherein said body is self-contained on all of its outer sides, namely on the horizontal outer upper surface (102), on the horizontal bottom side (102*b*), therefore on the horizontal walking side (33), and on the vertical circumferential sides (102*d*) and therefore directed to the shoe upper (30), consisting of rigid material with no inherent shock absorbing coefficient, with high density polyethylene HDPE measured in the elasticity module beginning from the upper Shore D hardness range to upwards Shore hardness ranges with a specific gravity between 0.9 to 2.0 g/cm$^3$, and/or wood, a springy-elastic outer envelope (6) representing the shock-absorbing unit and being a one-piece container structure, wherein the one-piece container structure of the outer envelope has a vertical circumferential (2*c*), a bottom side (102*c*), a vertical height (H) wherein the outer envelope (6) is self-contained with its side faces on at least three sides, namely in the circumference area with the vertical circumferential side (2*c*), and with the horizontal bottom side (102*c*) therefore with the horizontal walking side (33) by an outer layer of soft elastic, flexible elastomer material which can be changed in its Shore hardness degree measured in the elasticity module of Shore A hardness range, preferably between 60 and 80 degrees, with a specific gravity between 0.5 to 1.2 g/cm$^3$, whereby the outer envelope (6) has in its unloaded condition a higher vertical height elevation (H) of the vertical circumferential side (2*c*) than the vertical height (h) of the circumferential sides (102*d*) of the inelastic inner core body (1), and wherein the rigid inner core body (1) is surrounded on at least three sides namely on the outer circumferential sides (102*d*) and on the bottom side (102*b*) by an outer layer of soft elastic material forming the outer envelope (6) wherein the soft outer envelope has, when subjected to load, an elastic compressible shock absorbing part compressible vertically in the direction toward the longitudinal axis of the shoe heel, absorbing the weight during step in a springy elastic manner, wherein the shape of the outer envelope (6) essentially conforms to an outer shape of the rigid inner core body (1), and wherein an outer surface structure of the outer edge (7*e*) of the outer upper surface (102) of the inner core body (1) is form-matchingly engageable by an inner surface structure of the horizontal upper surface (102*a*) of the outer envelope (6).

In a first embodiment of the assembly structure as shown in FIG. 9*a,* the rounded-off lip of a flanged border 16*a* of the outer envelope 6 fits form-matchingly into the rounded-off rim gradation 1*a* of the rigid inner core body 1.

In a second embodiment of the assembly structure as shown in FIG. 9*b* and FIG. 4, the acute-angled or straight-angled lip hook of the flanged border 16*b* of the outer envelope 6 fits form-matchingly into the acute-angled or straight-angled rim hook gradation 1*b* of the rigid inner core body 1.

In the case of the two aforedescribed embodiments, firstly the outer envelope 6 can be lifted off after the shoe heel has been totally removed from the shoe upper 30, in that the respective projecting lips of the flanged outer envelope border, namely 16*a* rounded-off flange, 16*b* acute- or straight-flanged of the outer envelope 6 are removed from the respective rim gradations 1*a* and 1*b* of the rigid inner core body 1.

In a third embodiment of the assembly structure as shown in FIG. 9*c,* the flattened flanged border 16*d* of the outer envelope fits form-matchingly into the lateral flattened rim gradation 1*d* of the inner core body 1 and forms a snap locking.

In this case, it is also secondly possible to remove the outer envelope 6 from the heel without having to demount the entire shoe heel from the shoe upper 30 in that the flattened flanged border 16*d* of the outer envelope 6 is snapped off from the corresponding flattened rim 1*d* of the rigid inner core body 1.

In a fourth embodiment of the assembly structure as shown in FIG. 9*d,* the rigid inner core body 1 is placed into the outer envelope 6 and a decorative flange 16*e* of the outer envelope 6 surrounds and covers the entire circumferential face of the hump 1*e* of the rigid inner core body 1.

In a fifth embodiment of the assembly structure as shown for example in FIG. 5, the straight lip 2*a* of the outer envelope 6 fits form-matchingly to the straight upper surface 1*c* of the rigid inner core body 1. In this embodiment, the outer envelope 6 is permanently connected to the hard core body 1.

The outer envelope 6 is clamped into position when the heel is attached to the shoe upper 30. The outer envelope 6 can be placed on the rigid inner core body 1 in a separate step or the rigid inner core body 1 is already placed into the mold before the molding procedure of the outer envelope 6. As can be gathered from the figures, a fixed connection between the rigid inner core body 1 and the outer envelope 6 is not required. The outer envelope 6 is loosely positioned over the rigid inner core body 1, where the outer surfaces of the rigid inner core body 1 and the inner surfaces of the outer envelope 6 are loosely connected. Alternatively, the elastic material to form the outer envelope 6 can be loosely injection molded around the outer surfaces of the rigid inner core body 1, i.e. there is no fixed connection between the resulting inner surfaces of the outer envelope 6 and the outer surfaces of the rigid inner core body 1.

The attachment of the heel itself to the upper of the shoe can be performed by screws 3 and nails 3, as illustrated in FIG. 4, bonding glue, by a blind rivet 13 and nails 3, as illustrated in FIG. 2, or by other methods. In this case, the upper side 2 of the shoe heel facing the shoe upper 30 is sealed and closed by the horizontal upper side 102 of the rigid inner core body 1 and by the horizontal upper side 102*a* of the higher side walls 2*a* of the outer envelope 6, where the horizontal upper side 102 of the rigid inner core body 1 and the horizontal upper side face 102*a* of the outer envelope 6 form a first method of attaching the heel to the shoe upper 30, as illustrated for example in FIGS. 1 and 6.

The outer envelope 6 can exhibit an open envelope cover 9, where one side of the envelope cover 9 is injection molded in one injection molding operation to the horizontal upper side 102*a.* The envelope cover 9 can be sealed by means of nipples or locking grooves.

The outer envelope 6 can exhibit a horizontal cover 9*a,* which is injection molded together with the vertical outer walls 2*a* of the outer envelope 6 during the injection molding operation of the outer envelope 6.

If the horizontal upper side 102*a* of the outer envelope 6 or, respectively, the upper side 2 of the shoe heel is closed by a cover 9*a,* as illustrated in FIG. 3, or if the horizontal upper side 102*a* of the outer envelope 6 is closable by a cover 9, as illustrated in FIGS. 7, 10, 14, 15, and 17 by means of sealing nipples or grooves, the rigid inner core body 1 has a horizontal upper side 102 with a totally straight plane upper surface 1*c*. In this case, the closure of the shoe heel is performed towards the shoe upper 30 with the cover 9, 9*a* and with the horizontal upper side 102*a* of the outer envelope 6 in a second method of attaching the shoe heel to the shoe upper 30.

Depending on the type of intended use of the heel, the rigid inner core body 1 is fixedly cover 9*a* of the outer envelope 6, as illustrated in FIG. 3 or there is only a loose connection between the rigid inner core body 1 and the outer envelope 6, as illustrated in FIGS. 14–18. The outer envelope 6 can either be placed onto the rigid inner core body 1 in a separate operation, or the rigid inner core body 1 is inserted into the mold prior to the injection molding process of the outer envelope 6. The shoe heel can be attached to the shoe upper 30 with screws 3 and nails 3, or in any other way. The screws 3 and nails 3 penetrate through the cover 9, 9*a* of the outer envelope 6 into the rigid inner core body 1. For stabilizing the screws 3 or nails 3, there is provided a metallic or rigid-synthetic-material ring 10 in a corresponding recess in the cover 9, 9*a*. The cover 9, 9*a* of the outer envelope 6 is attached to the rigid inner core body 1 by means of bonding as for example illustrated in FIG. 3 or the cover 9, 9*a* of the outer envelope 6 is loosely placed over the rigid inner core body 1, as for example illustrated in FIG. 7. In other words, the inner walls of the outer envelope 6 with the cover 9, 9*a* have no fixed connection to the rigid inner core body 1, as for example illustrated in FIG. 6. Alternatively, the cover 9, 9*a* of the outer envelope 6 is fixedly bonded to the upper surface 102 of the rigid inner core body 1, where the inner side walls and the bottom inner walls of the outer envelope 6 are not connected to the corresponding outer walls of the rigid inner core body 1, as for example illustrated in FIG. 3.

If the shoe heel is manufactured without an outer envelope 6 with projecting lips 16*c,* 16*a,* 16*b* and a cover 9, 9*a,* there is a fixed connection 8 between the inner sides of the soft outer envelope 6 and the outer sides of the rigid inner core body 1, as illustrated in FIG. 5. The attachment of the shoe heel to the shoe upper 30 is realized by means of screws 3 and nails 3. In this third method of attaching the shoe heel to the shoe upper 30, the closure of the upper surface 2 of the shoe heel is performed with the upper surface 102 of the rigid inner core body 1 and the slightly raised upper surfaces 102*a* of the outer envelope 6, to the shoe upper 30.

Figure 12:
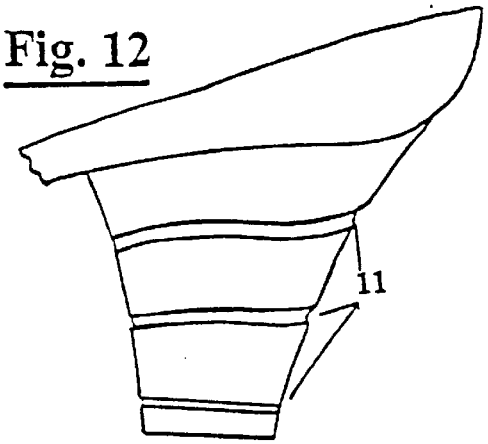
FIG. 12 is a side view of a high-heeled shape with slanted or horizontally progressing grooves in the outer side faces.
Figure 13:
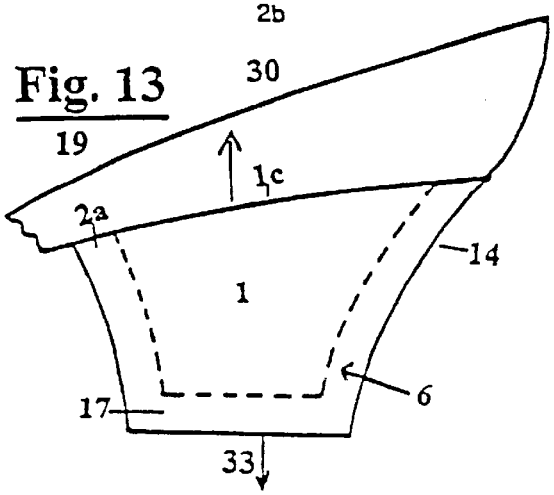
FIG. 13 is a side view of a high-heeled shape without grooves in the outer side faces, wherein the core body is surrounded by the outer envelope material at least on three sides, namely circumferentially and on the walking side.

Depending on the intended use of the invention heel, the shoe heel can be provided with one or more conical grooves 11, having varying shapes, in the outer side wall of the finished heel at the time of the molding process, as illustrated in FIG. 12, or the outer side wall of the finished heel exhibits a smooth surface 14, as illustrated in FIG. 13. The degree of shock absorption is higher where a shoe heel includes grooves 11 and where the outer envelope 6 of the shoe heel includes a soft cover 9, 9*a* as compared to a shoe heel without these features, since the compression force of the shoe heel, resulting from the force exerted by a foot heel onto a shoe heel during a step, can yield laterally into the grooves 11 due to a deformation of the material and since the springy elasticity increases during the decompression process. The height H of the soft outer envelope 6 is greater elevated than the height h of the rigid inner core body 1 in unloaded condition of the shoe heel.

Depending on the intended use of the invention shoe heel, the circumferential side walls 2*c* of the outer envelope 6, including projecting lips but not including a cover, can be fixedly attached to the outer circumferential surface 102*d* of the rigid inner core body 1 with a fixed connection 8. If the outer envelope 6 is provided with a cover, then the outer envelope 6 can be fixedly attached to the upper surface 102 of the rigid inner core body 1, as illustrated in FIG. 3.

According to a further embodiment of the invention shoe heel, the shoe heel also includes an outer envelope 6, manufactured as a one-piece structure, and a rigid inner core body 1. The rigid inner core body 1 comprises predrilled holes 35 in the upper surface 102 for attaching the shoe heel with screws 3 to the shoe upper as well as predrilled holes 110 in the bottom surface 102*b* of the rigid inner core body 1 in case a repair of the heel becomes necessary. During the repair operation, the whole width of the heel, patch 17 of the heel part of the outer envelope 6, manufactured as a one-piece structure, is cut horizontally from the shoe heel. Then, a heel patch 17*a,* made of the same material as the material of the outer envelope 6, is attached to the rigid inner core body 1 by means of pins 100, made of a rigid synthetic material, where the pins 100 are inserted into the predrilled holes 110 in the bottom surface 102*b* of the rigid inner core body 1. The heel patch 17 a can have a standard thickness 18 or an elevated thickness 18*a.*

The invention shoe heel can also manufactured in that wall thickness of the bottom surface 102*c* of the outer envelope 6 is injection-molded to have a minimum thickness 117 and in that the heel patch 17 is provided as a separate element. The heel patch 17 is made of the same material as the material of the outer envelope 6 and is attached to the actual heel with pins 100 made of a rigid synthetic material. The pins 100 are rigid and are either foamed onto the heel patch 17 after solidification of the heel patch or the pins 100 are inserted into the mold element prior to the injection molding process of the heel patch 17.

A fashionable appearance of the outer side walls of the shoe heel is achieved either by dyeing the material of the soft outer envelope 6 or by attaching an additional material to the outer side walls of the shoe heel.

All shoe heels can be manufactured either as an independently 19, self-contained part, as illustrated for example in FIGS. 1–8, 10–15 and 18, or together with the shoe sole as one unit 20, as for example illustrated in FIGS. 16 and 17. The sole may be provided of the same material as the material of the shoe heel, or the sole may be provided of another material.

There are varying forms of the inelastic rigid inner core body 1 as viewed in a direction toward the bottom surface 102*b* of the rigid inner core body 1.

Parallel conical taper relative to the outer side wall of the outer envelope 6: The rigid inner core body 1 is provided with a parallel conical taper, when viewed as a front view from the outer edge of the horizontal upper side 102 of the rigid inner core body 1 in direction of the outer edge of the horizontal bottom side 102*b* of the rigid inner core body 1, as illustrated in FIGS. 4, 10, 14, 15, 17, 18.

An inherent conical taper can be furnished. The rigid inner core body 1 is provided with an outer inherent conical taper, as viewed from the outer edge of the horizontal upper side 102 of the rigid inner core body 1 in a direction of the outer edge of the horizontal bottom side 102*b* of the rigid inner core body 1, as illustrated in FIGS. 1, 3, 7.

Alternatively, a concave taper with convexity can be furnished. The rigid inner core body 1 is provided with a concave taper with convex bulging at the lower part in the kind of an hour-glass shape, as viewed from the outer edge of the horizontal upper side 102 of the rigid inner core body 1 in a direction of the outer edge of the horizontal bottom side 102*b* of the rigid inner core body 1, as illustrated in FIGS. 2, 6, 8, 16.

Shrinkage spots, which can easily occur during the injection molding operation of the independent and separate outer envelope 6 on the finished heel, are prevented by inserting the rigid inner core body 1 into the mold prior to the injection molding operation. The outer envelope wall or the cover is clamped onto position during the attaching process to the shoe upper 30.

In case of any heel shape, the placement of the rigid inner core body 1 within the outer envelope 6 can be shifted in its height relative to the upper surface 2 of the heel or bottom surface 2*b* of the heel, depending on the intended use of the heel. As illustrated in FIG. 15, the rigid inner core body 1 is moved downwardly within the outer envelope 6, thereby resulting in a lesser wall thickness 117 of the bottom side 102*c* of the outer envelope 6. As illustrated in FIG. 1 or FIG. 5, the rigid inner core body 1 is placed higher in the outer envelope 6, based on a larger wall thickness of the bottom side 102*c* of the outer envelope 6.

The special structure of the shoe heel has the result that the intervertebral discs, the hips and joints are relieved while wearing elegant shoes having raised slim heels, thereby also contributing to maintain the health and fitness of persons by simultaneously resulting in high energy savings.

The outer envelope is either removable or connected by means of a fixed or loose connection to the rigid inner core body. Repair is possible by attaching a new heel patch or by removing the complete outer envelope. A longer length of a leg can be easily achieved by a corresponding increase of the heel patch of the shoe heel. As a result of the extremely simple and cost-effective manufacturing of the heel as well as the diverse variation possibilities, the invention shoe heel can be employed in shoes of all price groups.

The shoe heel having a high-heeled wedge shape, i.e. a vertically external high-heeled shape, has a measurement which is upright raised to a greater height elevation height associated with a comparatively small, external bottom surface 2*b,* disposed in a width in comparison to a longitudinal length of the outer upper surface of the shoe heel.

The shoe heel having an external high-heeled shape, is provided of a measurement which is upright raised to a greater height elevation associated with a comparatively small, external slim bottom surface 2*b,* disposed in a width in comparison to a longitudinal length of the external upper surface 2.

The shoe heel having a vertical external high-heeled shape, has dimensions which are upright raised in lower height with a comparatively broad, wide bottom surface 2*b,* disposed longitudinal, in comparison to the latitude of the external upper surface 2.

Heels for footwear are known from the German Utility Model No. DE/G 92 01.107.1, the German Patent No. DE/P 42 19 152.1-26, the international Patent Application No. PCT/DE92/00563, the German Utility Model No. DE/G 92 09 230.6, the German Utility Model No. DE/G 92 13 302.9, and the international Patent Application No. PCT/DE92/00845.

It will be understood that each of the elements described above, or two or more together, may also find a useful application in other types of heels differing from the types described above.

While the invention has been illustrated and described as embodied in the context of a step shock absorbing, fashionably raised heel for ladies' and gentlemen's footwear of the high-heeled shape or having a wedge shape, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A shock absorbing shoe heel comprising:

a rigid inner core having a top, a bottom, and at least one side having a vertical length extending between the top and the bottom and connecting the top and the bottom of the rigid inner core and a flexible outer envelope made of an elastic material, enclosing at least the bottom and the at least one side of the rigid inner core, and having an outer surface shaped in a form of a heel, the flexible outer envelope comprising:

(i) an outer bottom surface located below the bottom of the rigid inner core (ii) an outer side surface having a top portion, the outer side surface connected to and extending upwardly from the outer bottom surface and the top portion of the the outer side surface extending above the at least one side of the rigid inner core when the flexible outer envelope is in a noncompressed, unloaded state, and (iii) an inside surface adjacent to the at least one side of the rigid inner core, and wherein a majority of the inside surface of the flexible outer envelope is in slidable contact with at least a majority of the at least one side of the rigid inner core to facilitate compression of the flexible outer envelope relative to the rigid inner core and wherein the vertical length of the at least one side of the rigid inner core is at least twice a vertical distance between the outer bottom surface of the flexible outer envelope and the bottom of the rigid inner core.

2. The shock absorbing shoe heel of claim 1 wherein the the outer bottom surface of the flexible envelope has a horizontal length dimension and the outer side surface of the flexible outer envelope has a vertical length dimension from the top portion of the outer side surface of the flexible outer envelope to the outer bottom surface of the flexible outer envelope which is at least as great as the horizontal length dimension of the outer bottom surface of the flexible outer envelope.

3. The shock absorbing shoe heel of claim 2 wherein the vertical length of the at least one side of the rigid inner core is at least as great as a horizontal cross-sectional dimension of the bottom of the rigid inner core.

4. The shock absorbing shoe heel of claim 1 wherein the flexible outer envelope has a nonuniform wall thickness.

5. The shock absorbing shoe heel of claim 1 wherein the rigid core is comprised of wood.

6. The shock absorbing shoe heel of claim 1 wherein the rigid core is comprised of a rigid synthetic material.

7. The shock absorbing shoe heel of claim 1 wherein the flexible outer envelope is comprised of a soft elastic material.

8. The shock absorbing shoe heel of claim 1 wherein the rigid inner core is solid.

9. The shock absorbing shoe heel of claim 1 wherein the flexible outer envelope completely encases the rigid inner core.

10. The shock absorbing shoe heel of claim 9 wherein the flexible outer envelope is a two-piece assembly comprising a cover and the outer envelope, each having a corresponding sealing nipple and groove for mating.

11. The shock absorbing shoe heel of claim 10 wherein the flexible outer envelope is capable of replacement when worn.

12. The shock absorbing shoe heel of claim 9 wherein the flexible outer envelope is capable of replacement when worn.

13. The shock absorbing shoe heel of claim 1 wherein the flexible outer envelope further comprises at least one groove in outer side surface of the flexible outer envelope to further increase shock absorption in a lateral direction.

14. The shock absorbing shoe heel of claim 1 wherein the flexible outer envelope extends at least partially over the top of the rigid inner core.

15. The shock absorbing shoe heel of claim 14 wherein the flexible outer envelope is capable of replacement when worn.

16. The shock absorbing shoe heel of claim 14 wherein the inside surface of the flexible outer envelope further comprises an upper inner edge to engage an upper outer edge of the rigid inner core to provide a form-matching two-piece structure.

17. The shock absorbing shoe heel of claim 16 wherein the flexible outer envelope is capable of replacement when worn.

18. The shock absorbing shoe heel of claim 14 wherein the flexible outer envelope is loosely attached to the rigid inner core without a fastener connection.

19. The shock absorbing shoe heel of claim 18 wherein the flexible outer envelope is capable of replacement when worn.

20. A shock absorbing shoe heel comprising:

a rigid inner core comprising a top end attachable to a shoe, a bottom end having a horizontal cross-sectional base dimension and at least one side having a vertical length extending between the top end and the bottom end of the rigid inner core and connecting the top end and the bottom end of the rigid inner core;

a flexible outer envelope made of an elastic material and enclosing at least the bottom end and the at least one side of the rigid inner core, the flexible outer envelope having an outer surface shaped in a form of a heel and an inside surface adjacent to the at least one side and bottom end of the rigid inner core and wherein (i) a top portion of the outer surface of the flexible outer envelope extends above the top end of the rigid inner core when in a non-compressed, unloaded slate (ii) a majority of the inside surface of the flexible outer envelope adjacent to the at least one side of the rigid inner core is in slidable contact with at least a majority of the at least one side of the rigid inner core to facilitate compression of the flexible outer envelope relative to the rigid inner core and (iii) the rigid inner core has a shape which approximates the shape of the outer surface of the flexible outer envelope.

21. The shock absorbing shoe heel of claim 20 wherein the flexible outer envelope covers a portion of the top of the rigid inner core.

22. The shock absorbing shoe heel of claim 21 wherein the flexible outer envelope further comprises an upper inner edge to engage an upper outer edge of the rigid inner core to provide a form-matching two-piece structure.

23. The shock absorbing shoe heel of claim 22 wherein the flexible outer envelope is capable of replacement when worn.

24. The shock absorbing shoe heel of claim 21 wherein the flexible outer envelope is loosely attached to the rigid inner core without a fastener connection.

25. The shock absorbing shoe heel of claim 24 wherein the flexible outer envelope is capable of replacement when worn.

26. The shock absorbing shoe heel of claim 21 wherein the flexible outer envelope is capable of replacement when worn.

27. The shock absorbing shoe heel of claim 20 wherein the bottom end of the rigid inner core has a horizontal cross-sectional length dimension, and the vertical length of the rigid inner core is at least as great as the horizontal cross-sectional length dimension of the bottom end of the rigid inner core.

28. The shock absorbing heel of claim 27 wherein the bottom end of the flexible outer envelope has a horizontal cross-sectional length dimension and the flexible outer envelope has a vertical length at least twice as great as the horizontal cross-sectional length dimension of the bottom end of the flexible outer envelope and the vertical length of the rigid inner core is at least twice as great as the horizontal cross-sectional length dimension of the bottom end of the rigid inner core.

29. The shock absorbing shoe heel of claim 20 wherein the flexible outer envelope has a nonuniform wall thickness.

30. The shock absorbing shoe heel of claim 20 where the rigid core is comprised of wood.

31. The shock absorbing shoe heel of claim 20 wherein the rigid core is comprised of an inelastic rigid synthetic material.

32. The shock absorbing shoe heel of claim 20 wherein the flexible outer envelope is comprised of a soft elastic material.

33. The shock absorbing shoe heel of claim 20 wherein the rigid inner core is solid.

34. The shock absorbing shoe heel of claim 20 wherein the rigid inner core has one of a conical shape and a wedge shape.

35. The shock absorbing shoe heel of claim 34 wherein the rigid inner core has a high-heeled, conical-shape.

36. The shock absorbing shoe heel of claim 20 wherein the flexible outer envelope completely encases the rigid inner core.

37. The shock absorbing shoe heel of claim 36 wherein the flexible outer envelope is a two-piece assembly comprising a cover and the outer envelope, each having a corresponding sealing nipple and groove for mating.

38. The shock absorbing shoe heel of claim 37 wherein the flexible outer envelope is capable of replacement when worn.

39. The shock absorbing shoe heel of claim 36 wherein the flexible outer envelope is loosely attached to the rigid inner core without a fastener connection.

40. The shock absorbing shoe heel of claim 39 wherein the flexible outer envelope is capable of replacement when worn.

41. The shock absorbing shoe heel of claim 36 wherein the flexible outer envelope is capable of replacement when worn.

42. The shock absorbing shoe heel of claim 20 wherein the flexible outer envelope further comprises at least one groove in the outer surface of the flexible outer envelope to further increase shock absorption in a lateral direction.

43. A shock absorbing shoe heel comprising:

a rigid inner core having a top, a bottom, and at least one side having a vertical length extending between the top and the bottom of the rigid inner core and connecting the top and the bottom of the rigid inner core and a flexible outer envelope made of an elastic material, enclosing at least the bottom and the at least one side of the rigid inner core, and having an outer surface shaped in a form of a heel, the flexible outer envelope comprising:

(i) an outer bottom surface located below the bottom of the rigid inner core, (ii) an outer side surface having a top portion, the outer side surface connected to and extending upwardly from the outer bottom surface and the top portion of the outer side surface extending above the at least one side of the rigid inner core when the flexible outer envelope is in a noncompressed, unloaded state, and (iii) an inside surface adjacent to the bottom surface and the at least one side of the rigid inner core, and wherein a majority of the inside surface of the flexible outer envelope adjacent to the at least one side of the rigid inner core is in slidable contact with at least a majority of the at least one side of the rigid inner core to facilitate compression of the flexible outer envelope relative to the rigid inner core; and wherein the vertical length of the rigid inner core is at least twice a vertical distance between the outer bottom surface of the flexible outer envelope and the bottom of the rigid inner core and wherein the rigid inner core has a shape which approximates the shape of the outer surface of the flexible outer envelope.

* * * * *

UNITED STATES PATENT AND TRADEMARK OFFICE

CERTIFICATE OF CORRECTION

PATENT NO. : 5,829,168

DATED : November 3, 1998

INVENTOR(S) : Ingeborg Fusaro

It is certified that error appears in the above-identified patent and that said Letters Patent is hereby corrected as shown below:

On the title page, item [56] add the following:

U.S. PATENT DOCUMENTS

| | | |
|---|---|---|
| 2,807,100 | 9/1957 | Windle |
| 2,347,868 | 5/1944 | Allen |
| 2,255,177 | 9/1941 | Lyness |
| 1,530,159 | 3/1925 | Fletcher |
| 313,291 | 3/1885 | Deemar |
| 122,112 | 12/1871 | Eggleston |
| 050,026 | 9/1865 | Newhall |
| 2,048,683 | 7/1936 | Brockman |

Add the following references under FOREIGN PATENT DOCUMENTS

| | | |
|---|---|---|
| 0149098 | 10/1950 | Australia |
| 0568704 | 11/1957 | Italy |
| 759737 | 2/1934 | France |
| 8299 | 2/1908 | France |

Add the following references under OTHER PUBLICATIONS

Goodrich, American Shoe Making, July 11, 1934, page 18

Forman, Improved Rubber heel, 11/1914, page 43

UNITED STATES PATENT AND TRADEMARK OFFICE

CERTIFICATE OF CORRECTION

PATENT NO. : 5,829,168

DATED : November 3, 1998

INVENTOR(S) : Ingeborg Fusaro

It is certified that error appears in the above-identified patent and that said Letters Patent is hereby corrected as shown below:

Column 10, line 66: Delete "the" and replace it with --an--.

Column 12, line 23: Insert --connected to the-- before "cover 9a..."

Column 14, line 23: Replace "onto" with --into--.

Column 14, line 52: Delete the second occurrence of the word "height".

Column 16, line 67: Replace the word "slate" with --state--.

Signed and Sealed this

Sixth Day of July, 1999

*Attest:*

Q. TODD DICKINSON

*Attesting Officer*

*Acting Commissioner of Patents and Trademarks*